US011322281B2

(12) United States Patent
Ohta

(10) Patent No.: US 11,322,281 B2
(45) Date of Patent: May 3, 2022

(54) MULTILAYER BLOCK CORE, MULTILAYER BLOCK, AND METHOD FOR PRODUCING MULTILAYER BLOCK

(71) Applicants: HITACHI METALS, LTD., Tokyo (JP); Metglas, Inc., Conway, SC (US)

(72) Inventor: Motoki Ohta, South Carolina, SC (US)

(73) Assignees: HITACHI METALS, LTD., Tokyo (JP); Metglas, Inc., Conway, SC (US)

( * ) Notice: Subject to any disclaimer, the term of this patent is extended or adjusted under 35 U.S.C. 154(b) by 400 days.

(21) Appl. No.: 16/080,300

(22) PCT Filed: Feb. 27, 2017

(86) PCT No.: PCT/JP2017/007460
§ 371 (c)(1),
(2) Date: Aug. 27, 2018

(87) PCT Pub. No.: WO2017/150441
PCT Pub. Date: Sep. 8, 2017

(65) Prior Publication Data

US 2019/0074115 A1 Mar. 7, 2019

Related U.S. Application Data

(60) Provisional application No. 62/300,937, filed on Feb. 29, 2016.

(51) Int. Cl.
*C22C 45/02* (2006.01)
*H01F 1/153* (2006.01)
(Continued)

(52) U.S. Cl.
CPC ..... *H01F 1/15333* (2013.01); *C22C 33/003* (2013.01); *C22C 45/02* (2013.01);
(Continued)

(58) Field of Classification Search
CPC ..... C22C 33/003; C22C 45/02; H01F 1/153; H01F 1/15333; H01F 1/15341; H01F 27/24; H01F 41/02; H01F 41/0226
(Continued)

(56) References Cited

U.S. PATENT DOCUMENTS 3,550,266 A * 12/1970 Hirst ..... H01F 41/0233 29/609
2006/0000525 A1* 1/2006 Naoe ..... H01F 1/15308 148/304
(Continued)

FOREIGN PATENT DOCUMENTS

CN 104619875 A 5/2015
JP 2006-310787 A 11/2006
(Continued)

OTHER PUBLICATIONS

NPL: English on-line translation of JP 2014125675 A, Jul. 2014 (Year: 2014).*
(Continued)

*Primary Examiner* — Jie Yang
(74) *Attorney, Agent, or Firm* — Solaris Intellectual Property Group, PLLC

(57) ABSTRACT

A multilayer block core includes a multilayer block in which nanocrystalline alloy ribbon pieces are layered, the nanocrystalline alloy ribbon pieces having a composition represented by the following Composition Formula (A).

$$Fe_{100-a-b-c-d}B_aSi_bCu_cM_d \quad \text{Composition Formula (A)}$$

In Composition Formula (A), each of a, b, c, and d is an atomic percent; the expressions $13.0 \le a \le 17.0$, $3.5 \le b \le 5.0$, $0.6 \le c \le 1.1$, and $0 \le d \le 0.5$ are satisfied; and M represents at least one element selected from the group consisting of Ti, Zr, Hf, V, Nb, Ta, Cr, Mo, and W.

5 Claims, 2 Drawing Sheets

(51) Int. Cl.

| | |
|---|---|
| ***H01F 27/24*** | (2006.01) |
| ***H01F 41/02*** | (2006.01) |
| ***C22C 33/00*** | (2006.01) |

(52) U.S. Cl.
CPC ..... *H01F 1/153* (2013.01); *H01F 1/15341* (2013.01); *H01F 27/24* (2013.01); *H01F 41/02* (2013.01); *H01F 41/0226* (2013.01)

(58) Field of Classification Search
USPC ..... 148/304
See application file for complete search history.

(56) References Cited

U.S. PATENT DOCUMENTS

| | | | | |
|---|---|---|---|---|
| 2015/0243421 | A1 | 8/2015 | Ohta et al. | |
| 2016/0196907 | A1* | 7/2016 | Ohta | H01F 1/15333 148/108 |

FOREIGN PATENT DOCUMENTS

| | | | |
|---|---|---|---|
| JP | 2009-110998 | A | 5/2009 |
| JP | 2009-200428 | A | 9/2009 |
| JP | 2013-048138 | A | 3/2013 |
| JP | 2014-125675 | A | 7/2014 |
| JP | 2014-240516 | A | 12/2014 |
| JP | 2015-095500 | A | 5/2015 |
| WO | 2008/133301 | A1 | 11/2008 |
| WO | 2014/038705 | A1 | 3/2014 |
| WO | 2015/046140 | A1 | 4/2015 |

OTHER PUBLICATIONS

Extended European Search Report dated Aug. 23, 2019, issued in corresponding EP Patent Application No. 17759907.3.
English language translation of the following: Office action dated Nov. 5, 2020 from the TIPO in a Taiwan patent application No. 106106631 corresponding to the instant patent application. This office action translation is submitted now in order to supplement the understanding of the cited reference which is being disclosed in the instant Information Disclosure Statement.

* cited by examiner

MULTILAYER BLOCK CORE, MULTILAYER BLOCK, AND METHOD FOR PRODUCING MULTILAYER BLOCK

CROSS REFERENCE TO RELATED APPLICATIONS

This application is a National Stage filing, under 35 U.S.C. § 371, of International Application No. PCT/JP2017/007460, filed Feb. 27, 2017, which claims priority to U.S. Patent Application No. 62/300,937, filed Feb. 29, 2016. Each of the above applications is hereby expressly incorporated by reference, in its entirety, into the present application.

TECHNICAL FIELD

The present invention relates to a multilayer block core, a multilayer block, and a method for producing a multilayer block.

BACKGROUND ART

Silicon steel, ferrite, Fe-based amorphous alloys, Fe-based nanocrystalline alloys and the like are known as magnetic materials for magnetic cores (cores) used in transformers, reactors, choke coils, motors, noise countermeasure components, power supplies for lasers, pulsed-power magnetic components for accelerators, generators, and the like.

A toroidal core prepared using an Fe-based amorphous alloy ribbon is known as a core (see, for example, Patent Document 1).

Further, a toroidal core prepared using an Fe-based nanocrystalline alloy ribbon is also known as a core (see, for example, Patent Document 2).

Patent Document 1: Japanese Patent Application Laid-Open (JP-A) No. 2006-310787

Patent Document 2: International Publication (WO) No. 2015/046140

SUMMARY OF INVENTION

Technical Problem

The toroidal cores described in Patent Documents 1 and 2 are also called "wound magnetic cores" or "wound cores", since these toroidal cores are produced by winding an alloy ribbon.

The wound cores need to be produced by winding an alloy ribbon so as to achieve a desired inner diameter and outer diameter, followed by performing heat treatment. Owing to these restrictions on the production conditions, the size range of wound cores that can be produced may be limited. Accordingly, wound cores are problematic in that there is a low degree of freedom in designing the core size.

Further, in the toroidal core (wound core) using an Fe-based amorphous alloy ribbon described in Patent Document 1, the rate of decrease in saturated magnetic flux density (Bs) relative to temperature rise is large at high temperatures (for example, from 100° C. to 200° C.). Therefore, the saturated magnetic flux density (Bs) of the toroidal core described in Patent Document 1 tends to be low at high temperatures.

In addition, in the toroidal core (wound core) using an Fe-based nanocrystalline alloy ribbon described in Patent Document 2, the saturated magnetic flux density (Bs) tends to be low at room temperature.

In view of the foregoing, a multilayer block core with a superior degree of freedom in designing the core size and that maintains a high saturated magnetic flux density (Bs) over a wide temperature region including high temperatures (for example, from 100° C. to 200° C.) is required, together with a multilayer block that is favorable as a component of the multilayer block core, and a method for producing the multilayer block.

Solution to Problem

Specific means for addressing the foregoing problems include the following embodiments.

<1> A multilayer block core including a multilayer block in which nanocrystalline alloy ribbon pieces are layered, the nanocrystalline alloy ribbon pieces having a composition represented by the following Composition Formula (A).

$$Fe_{100-a-b-c-d}B_aSi_bCu_cM_d \qquad \text{Composition Formula (A)}$$

In Composition Formula (A), each of a, b, c, and d is an atomic percent, and the expressions $13.0 \le a \le 17.0$, $3.5 \le b \le 5.0$, $0.6 \le c \le 1.1$, and $0 \le d \le 0.5$ are satisfied. M represents at least one element selected from the group consisting of Ti, Zr, Hf, V, Nb, Ta, Cr, Mo, and W.

<2> The multilayer block core according to <1>, wherein the space factor is from 85% to 92%.

<3> The multilayer block core according to <1> or <2>, wherein:

each of the nanocrystalline alloy ribbon pieces has a rectangular shape, the multilayer block has a rectangular parallelopiped shape, the multilayer block core is provided with at least four of the multilayer blocks, the at least four multilayer blocks are arranged in the shape of a rectangular ring, and a layering direction of the nanocrystalline alloy ribbon pieces in the multilayer blocks arranged in the shape of a rectangular ring is the same direction as a normal line direction of an arrangement face of the multilayer blocks arranged in the shape of a rectangular ring.

<4> The multilayer block core according to any one of <1> to <3>, wherein each of the nanocrystalline alloy ribbon pieces has a thickness of from 10 μm to 30 μm, a width of from 5 mm to 100 mm, and a ratio of length to width of from 1 to 10.

<5> The multilayer block core according to any one of <1> to <4>, wherein each of the nanocrystalline alloy ribbon pieces contains nanocrystal grains having a grain size of from 1 nm to 30 nm in an amount of from 30% by volume to 60% by volume.

<6> A multilayer block in which nanocrystalline alloy ribbon pieces are layered, the nanocrystalline alloy ribbon pieces having a composition represented by the following Composition Formula (A).

$$Fe_{100-a-b-c-d}B_aSi_bCu_cM_d \qquad \text{Composition Formula (A)}$$

[In Composition Formula (A), each of a, b, c, and d is an atomic percent, the expressions $13.0 \le a \le 17.0$, $3.5 \le b \le 5.0$, $0.6 \le c \le 1.1$, and $0 \le d \le 0.5$ are satisfied. M represents at least one element selected from the group consisting of Ti, Zr, Hf, V, Nb, Ta, Cr, Mo, and W.]

<7> A method for producing the multilayer block according to <6>, wherein the method includes:

preparing an amorphous alloy ribbon having a composition represented by Composition Formula (A);

causing the amorphous alloy ribbon to travel continuously with tension F applied thereto, and bringing a partial region of the amorphous alloy ribbon, which is traveling continuously with tension F applied thereto, into contact with a heat transfer medium, whose temperature is maintained at 450° C. or higher, under conditions that satisfy the following Formula (1), whereby the temperature of the amorphous alloy ribbon is raised to an achievable temperature of 450° C. or higher at a temperature increase rate in which an average temperature increase rate in a temperature range of from 350° C. to 450° C. is 10° C./sec or higher, to obtain a nanocrystalline alloy ribbon;

cutting out nanocrystalline alloy ribbon pieces from the nanocrystalline alloy ribbon; and layering the nanocrystalline alloy ribbon pieces, to obtain the multilayer block.

$$t_c > 4/\sigma \quad \text{[Formula (1)]}$$

[In Formula (1), $t_c$ represents a time (sec) from a moment at which an arbitrary point of the amorphous alloy ribbon touches the heat transfer medium until a moment at which the arbitrary point separates from the heat transfer medium. $\sigma$ is defined by the following Formula (X), and represents a contact pressure (kPa) between the amorphous alloy ribbon and the heat transfer medium.]

$$\sigma = ((F \times (\sin\theta + \sin\alpha))/a) \times 1000 \quad \text{[Formula (X)]}$$

[In Formula (X), F represents a tension (N) applied to the amorphous alloy ribbon.

a represents a contact area ($mm^2$) between the amorphous alloy ribbon and the heat transfer medium.

$\theta$ is an angle formed by a travel direction of the amorphous alloy ribbon just before touching the heat transfer medium and a travel direction of the amorphous alloy ribbon at a time of being in contact with the heat transfer medium, and represents an angle of from 3° to 60°.

$\alpha$ is an angle formed by the travel direction of the amorphous alloy ribbon at the time of being in contact with the heat transfer medium and the travel direction of the nanocrystalline alloy ribbon just after separating from the heat transfer medium, and represents an angle of greater than 0° but no greater than 15°.]

Advantageous Effects of Invention

According to the present invention, a multilayer block core which is excellent in the degree of freedom in designing the core size and maintains a high saturated magnetic flux density (Bs) over a wide temperature region including high temperatures (for example, from 100° C. to 200° C.); a multilayer block which is favorable as a component of the multilayer block core, and a method for producing the multilayer block may be provided.

DESCRIPTION OF EMBODIMENTS

Figure 1:
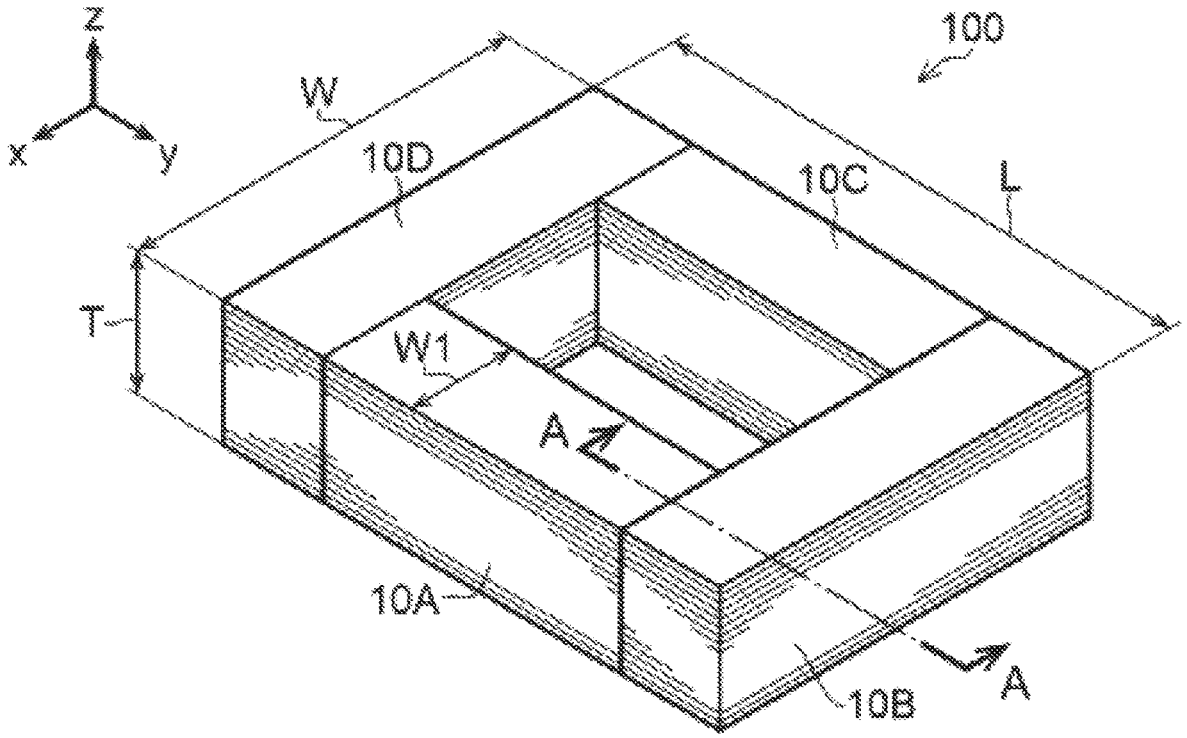
FIG. 1 is a perspective view schematically showing a multilayer block core (multilayer block core 100) according to a specific example of the embodiment of the invention.

Hereinafter, embodiments of the invention will be described.

In this specification, a numerical range expressed using "to" means a range including numeral values described in front of and behind "to" as the lower limit value and the upper limit value.

Further, in this specification, the term "process" includes not only an independent process, but also a case which cannot be clearly distinguished from other process, as far as the predetermined action of the process is achieved.

Further, in this specification, the term "nanocrystalline alloy ribbon" means a long alloy ribbon containing nanocrystals. For example, the concept of the term "nanocrystalline alloy ribbon" encompasses not only an alloy ribbon which consists of only nanocrystals, but also an alloy ribbon in which nanocrystals are dispersed in an amorphous phase.

Further, in this specification, the "nanocrystalline alloy ribbon piece" means a member which has a length shorter than that of the nanocrystalline alloy ribbon and is obtained by cutting a (long) nanocrystalline alloy ribbon into a strip shape.

Further, in this specification, the content (atom %) of each of the elements such as Fe, B, Si, Cu, M (here, M represents at least one element selected from the group consisting of Ti, Zr, Hf, V, Nb, Ta, Cr, Mo, and W) or the like means a content (atom %) when the total of Fe, B, Si, Cu, and M is taken as 100 atom %.

Furthermore, in this specification, as the angle formed by two line segments (specifically, $\theta$ or $\alpha$), the smaller angle (an angle within a range of from 0° to 90°) among the two defined angles is adopted.

[Multilayer Block and Multilayer Block Core]

The multilayer block according to the embodiment of the invention is a multilayer block in which nanocrystalline alloy ribbon pieces having a composition represented by the following Composition Formula (A) are layered.

The multilayer block core according to the embodiment of the invention is provided with the above multilayer block.

$$Fe_{100-a-b-c-d}B_aSi_bCu_cM_d. \quad \text{Composition Formula (A)}$$

[In Composition Formula (A), each of a, b, c, and d is an atomic percent, and the expressions $13.0 \le a \le 17.0$, $3.5 \le b \le 5.0$, $0.6 \le c \le 1.1$, and $0 \le d \le 0.5$ are satisfied. M represents at least one element selected from the group consisting of Ti, Zr, Hf, V, Nb, Ta, Cr, Mo, and W.]

According to the multilayer block core of the embodiment of the invention, the problem that the degree of freedom in designing the core size is poor in wound cores is addressed. Namely, in the multilayer block core of the embodiment of the invention, the degree of freedom in designing the core size is high. For example, in the multilayer block core of the embodiment of the invention, by changing at least one of the size of the multilayer block or the number of the multilayer blocks to be used in combination, multilayer block cores of various sizes can be realized.

Further, according to the multilayer block core of the embodiment of the invention, other problems in wound cores, for example, the problem that the eddy current loss is likely to increase, the problem that the production process is likely to be complicated since there is a need to deform through bending in order to realize a desired curvature, and the like, are also addressed.

In the multilayer block core of the embodiment of the invention, nanocrystalline alloy ribbon pieces are used. Accordingly, the multilayer block core of the embodiment of the invention has a high saturated magnetic flow density (Bs) (for example, Bs of 1.70 T or higher), as compared with a core using an amorphous alloy.

Note that, in this specification, the saturated magnetic flow density (Bs) means a value measured using a VSM (Vibrating Sample Magnetometer) with respect to a ribbon piece incorporated in the multilayer block core.

Moreover, according to the multilayer block core of the embodiment of the invention, the problem relating to a core using an amorphous alloy (specifically, the problem that the magnetic properties are likely to be deteriorated, especially, under a high temperature environment, since the rate of decrease in saturated magnetic flux density (Bs) relative to temperature rise is large) is also addressed.

In the multilayer block core of the embodiment of the invention, the rate of decrease in saturated magnetic flux density (Bs) relative to temperature rise can be reduced, for example, to be from −0.0004 T/° C. to 0.0007 T/° C. in a temperature range of from 100° C. to 200° C. This rate of decrease in Bs is about a half of that in the case of a multilayer block core using an amorphous alloy ribbon having a composition of $Fe_{80}Si_9B_{11}$ (each of the suffixes is an atomic percent).

Accordingly, in the multilayer block core of the embodiment of the invention, a high saturated magnetic flux density (Bs) is maintained over a wide temperature region including high temperatures (for example, from 100° C. to 200° C., and further, from 150° C. to 200° C.).

The nanocrystalline alloy ribbon pieces incorporated in the multilayer block core of the embodiment of the invention have a composition represented by the above Composition Formula (A).

This composition is a composition involving Fe in an amount of 76.4 (=100−a−b−c−d=100−17.0−5.0−1.1−0.5) atom % or higher.

Owing to this high Fe content (76.4 atom % or higher), the nanocrystalline alloy ribbon pieces incorporated in the multilayer block core of the embodiment of the invention have a high Curie temperature (Tc) (for example, from 680° C. to 720° C.).

A space factor of the multilayer block core according to the embodiment of the invention is preferably 85% or higher, and more preferably 86% or higher, from the viewpoint of decreasing the cross-sectional area of the core.

Meanwhile, from the viewpoint of suitability for production, the space factor of the multilayer block core according to the embodiment of the invention is preferably 92% or lower, and more preferably 90% or lower.

From the above viewpoints, the space factor of the multilayer block core according to the embodiment of the invention is preferably from 85% to 92%, and preferably from 86% to 90%, Note that, the preferable range of the space factor of the multilayer block according to the embodiment of the invention is substantially the same as the preferable range of the space factor of the multilayer block core according to the embodiment of the invention.

A preferable example of a mode of the multilayer block core according to the embodiment of the invention is a mode in which each of the nanocrystalline alloy ribbon pieces has a rectangular shape, the multilayer block has a rectangular parallelopiped shape, the multilayer block core is provided with at least four of the multilayer blocks, in which the at least four multilayer blocks are arranged in the shape of a rectangular ring, and the layering direction of the nanocrystalline alloy ribbon pieces in the multilayer blocks arranged in the shape of a rectangular ring is the same direction as the normal line direction of the arrangement face of the multilayer blocks arranged in the shape of a rectangular ring.

In such a mode, the layering direction of the nanocrystalline alloy ribbon pieces in each of the multilayer blocks arranged in the shape of a rectangular ring is aligned to the same direction as the normal line direction of the arrangement face of these multilayer blocks (see, for example, FIG. 1 and FIG. 3 described below). Accordingly, drawing attention to the adjoining portion between the multilayer blocks, in this adjoining portion, the face including the end faces of the nanocrystalline alloy ribbon pieces in a specific multilayer block and the face including the end faces of the nanocrystalline alloy ribbon pieces in another multilayer block adjoining the specific multilayer block are arranged to face each other. Thus, a closed magnetic path is formed, which extends over the specific multilayer block and the other multilayer block adjacent thereto and in which leakage of magnetic flux is suppressed. By the formation of such a closed magnetic path, core losses are reduced and deterioration in magnetic permeability is suppressed.

In the multilayer block core according to the embodiment of the invention, it is preferable that each of the nanocrystalline alloy ribbon pieces has a thickness of from 10 μm to 30 μm.

When the thickness is 10 μm or more, the mechanical strength of the nanocrystalline alloy ribbon piece is ensured, and breakage of the nanocrystalline alloy ribbon piece is prevented. The thickness of the nanocrystalline alloy ribbon piece is preferably 15 μm or more, and more preferably 20 μm or more.

When the thickness is 30 μm or less, a stable amorphous state can be obtained in the amorphous alloy ribbon, which is the raw material of the nanocrystalline alloy ribbon piece.

In the multilayer block core according to the embodiment of the invention, it is preferable that each of the nanocrystalline alloy ribbon pieces has a width of from 5 mm to 100 mm.

When the width of the nanocrystalline alloy ribbon piece is 5 mm or more, suitability for production is excellent.

When the width of the nanocrystalline alloy ribbon piece is 100 mm or less, a stable productivity is easily ensured. From the viewpoint of further improving the stable productivity, the width of the nanocrystalline alloy ribbon piece is preferably 70 mm or less.

In the multilayer block core according to the embodiment of the invention, it is preferable that each of the nanocrystalline alloy ribbon pieces has a ratio (length/width) of length to width of from 1 to 10.

When the ratio of length to width is from 1 to 10, the degree of freedom in designing the core size of the multilayer block core is further improved.

In this specification, the length of the nanocrystalline alloy ribbon piece means the length of the nanocrystalline alloy ribbon piece in the longitudinal direction (in a case in which the nanocrystalline alloy ribbon piece has a rectangular shape, the length of a long side), and the width of the nanocrystalline alloy ribbon piece means the length of the nanocrystalline alloy ribbon piece in the width direction (in a case in which the nanocrystalline alloy ribbon piece has a rectangular shape, the length of a short side).

It is preferable that each of the nanocrystalline alloy ribbon pieces has a thickness of from 10 μm to 30 μm, a width of from 5 mm to 100 mm, and a ratio of length to width of from 1 to 10. Preferable ranges of the thickness, width, and ratio of length to width are each as described above.

In the multilayer block core according to the embodiment of the invention, it is preferable that each of the nanocrystalline alloy ribbon pieces contains nanocrystal grains having a grain size of from 1 nm to 30 nm in an amount of from 30% by volume to 60% by volume.

Thereby, the magnetic properties of the multilayer block core are further improved.

It is more preferable that each of the nanocrystalline alloy ribbon pieces contains nanocrystal grains having a grain size of from 1 nm to 30 nm in an amount of from 40% by volume to 50% by volume.

Further, each of the nanocrystalline alloy ribbon pieces preferably contains nanocrystal grains having an average grain size of from 5 nm to 20 nm in an amount of from 30% by volume to 60% by volume, and more preferably from 40% by volume to 50% by volume.

<Specific Examples of Multilayer Block and Multilayer Block Core>

Next, specific examples of the multilayer block and multilayer block core according to the embodiment of the invention will be described with reference to FIG. 1 to FIG. 3.

FIG. 1 is a perspective view schematically showing a multilayer block core (multilayer block core 100) according to a specific example of the embodiment of the invention. FIG. 2 is a perspective view schematically showing one multilayer block (multilayer block 10A) of a multilayer block core according to a specific example of the embodiment of the invention. FIG. 3 includes a cross-sectional view along the line A-A in FIG. 1, and an enlarged fragmentary view thereof (the portion surrounded by an oval line).

As shown in FIG. 1, the multilayer block core 100 is provided with four multilayer blocks (multilayer blocks 10A to 10D), and these multilayer blocks 10A to 10D are arranged in the shape of a rectangular ring.

Figure 2:
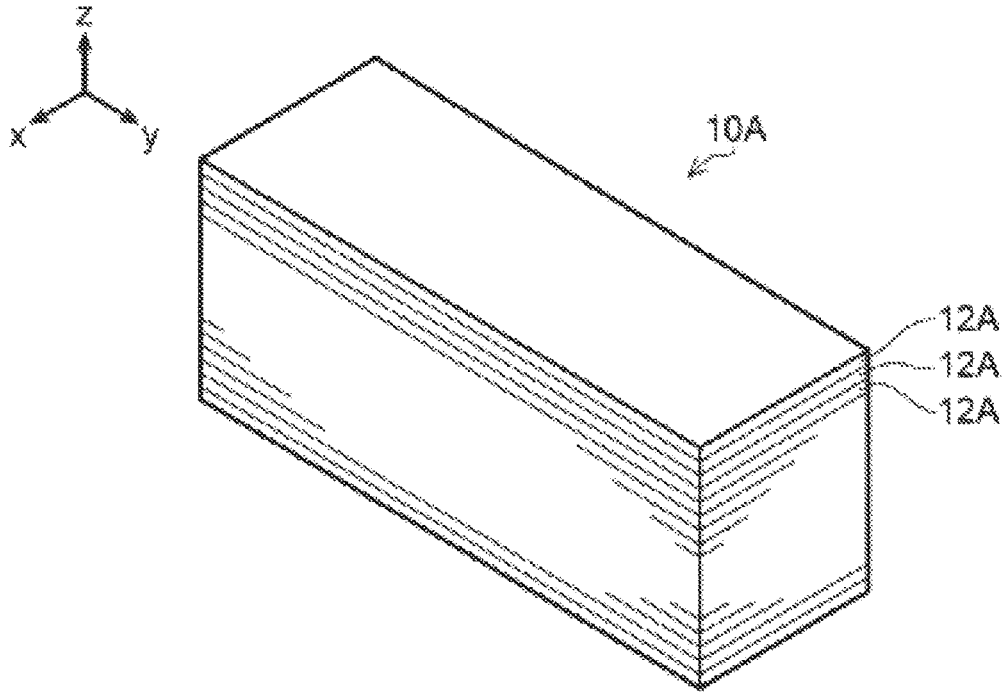
FIG. 2 is a perspective view schematically showing one multilayer block (multilayer block 10A) of a multilayer block core according to a specific example of the embodiment of the invention.
Figure 3:
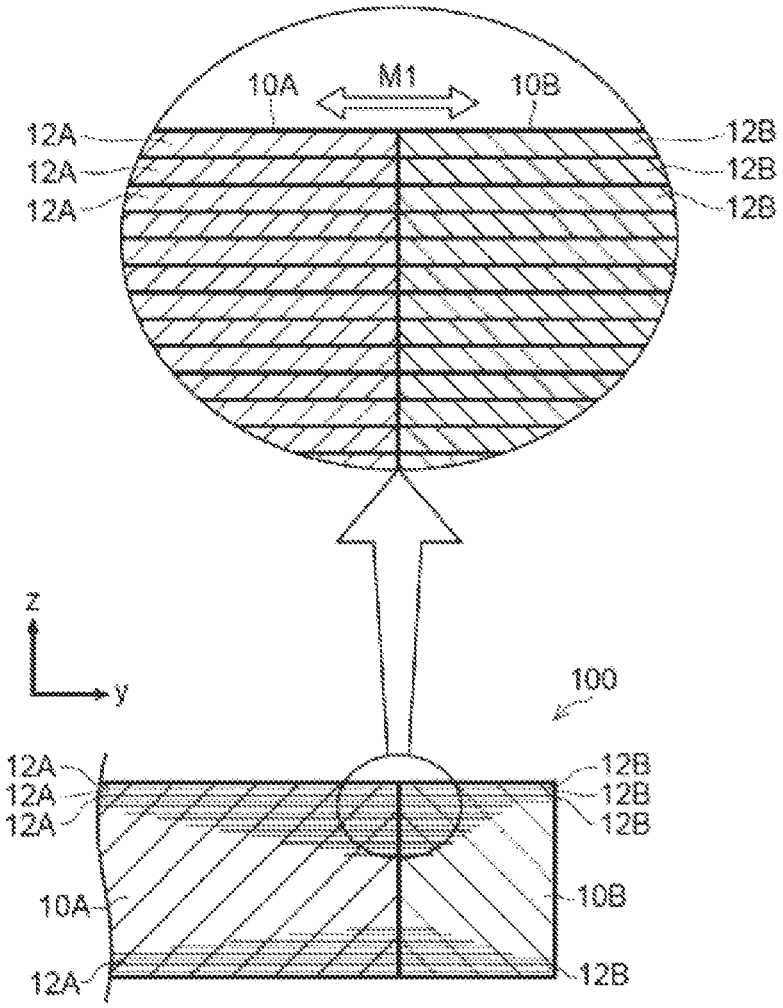
FIG. 3 is a cross-sectional view along the line A-A in FIG. 1.

In FIG. 1 to FIG. 3, the arrangement face of the multilayer blocks 10A to 10D arranged in the shape of a rectangular ring is taken as the xy plane (a plane including the x axis and the y axis), and the normal line direction of this arrangement face is taken as the z axis direction.

As shown in FIG. 2, the multilayer block 10A incorporated in the multilayer block core 100 is a rectangular parallelopiped block having a structure in which long, flat plate-shaped nanocrystalline alloy ribbon pieces 12A are layered. Although illustration is omitted, a resin such as an acrylic resin or an epoxy resin is impregnated between the plural nanocrystalline alloy ribbon pieces 12A, and the resin is cured. Due to this cured resin, the plural nanocrystalline alloy ribbon pieces 12A are fixed to one another and the rectangular parallelopiped shape of the multilayer block 10A is maintained.

The configuration of each of the multilayer blocks 10B to 10D is also substantially the same as the configuration of the multilayer block 10A.

However, the size of each of the multilayer blocks is set as appropriate according to the size of the multilayer block core 100. Thus, the sizes of the multilayer blocks (particularly, the length in the longitudinal direction) may be different from one another.

Note that, in FIG. 1 to FIG. 3, only a portion of a nanocrystalline alloy ribbon piece is illustrated, and illustration of the rest of the nanocrystalline alloy ribbon piece is omitted.

As shown in FIG. 1, in the multilayer block core 100, the layering direction of the nanocrystalline alloy ribbon pieces in each of the multilayer blocks 10A to 10D is the same direction as the normal line direction (z axis direction) of the arrangement face (xy plane) of the multilayer blocks 10A to 10D arranged in the shape of a rectangular ring. Accordingly, as shown in FIG. 3, at the adjoining portion between the multilayer block 10A and the multilayer block 10B, the face including the end faces of the nanocrystalline alloy ribbon pieces 12A in the multilayer block 10A and the face including the end faces of the nanocrystalline alloy ribbon pieces 12B in the multilayer block 10B are arranged to face each other. As a result, a magnetic path M1 is formed, which communicates with the multilayer block 10A and the multilayer block 10B. As described above, in the multilayer block core 100, the faces, each of which includes the end faces of the nanocrystalline alloy ribbon pieces, in the multilayer blocks that adjoin each other are arranged to face each other. Accordingly, in the multilayer block core 100, leakage magnetic flux between the multilayer blocks, which adjoin each other, is suppressed and, as a result, reduction in core losses and deterioration in magnetic permeability are suppressed.

Further, although illustration is omitted, also in the adjoining portions between other multilayer blocks, the faces each including the end faces of the nanocrystalline alloy ribbon pieces are arranged to face each other.

By having such a structure, in the multilayer block core 100, a closed magnetic path which goes round through the multilayer blocks 10A to 10D is formed. Due to such a closed magnetic path, core losses are reduced and deterioration in magnetic permeability is suppressed.

Unlike the specific example of the invention, it is possible to arrange the four multilayer blocks that constitute a rectangular ring shape such that the normal line direction of the arrangement face of these four multilayer blocks is orthogonal to the layering direction of the nanocrystalline alloy ribbon pieces in each of the multilayer blocks (hereinafter, this arrangement is referred to as "arrangement C"). However, in the arrangement C, at the adjoining portion between two multilayer blocks, the face (hereinafter, also referred to as "end face of the multilayer block") including the end faces of the nanocrystalline alloy ribbon pieces in one multilayer block and the main face (namely, the face orthogonal to the thickness direction of the nanocrystalline alloy ribbon piece) of the nanocrystalline alloy ribbon piece in the other multilayer block are arranged to face each other. Accordingly, in this mode, leakage of magnetic flux is extremely large, between the end face of one multilayer block and the main face of the nanocrystalline alloy ribbon piece in the other multilayer block. That is, in the above arrangement C, since the leakage magnetic flux between the multilayer blocks that adjoin each other is large, core losses are large and magnetic permeability is low, as compared with the specific example of the invention.

Referring to FIG. 1, a preferable size of the multilayer block core 100 is described. However, the size of the multilayer bock core according to the embodiment of the invention is not limited to the following preferable size.

The length L of the multilayer block core 100 in the longitudinal direction is preferably from 50 mm to 1000 mm, and more preferably from 100 mm to 500 mm.

The length W of the multilayer block core 100 in the width direction is preferably from 10 mm to 200 mm, and more preferably from 15 mm to 100 mm.

The thickness T of the multilayer block core 100 is preferably from 3 mm to 100 mm, and more preferably from 5 mm to 50 mm. Note that, the thickness T of the multilayer block core 100 corresponds to the layering thickness of the nanocrystalline alloy ribbon pieces.

The frame width W1 of the multilayer block core 100 corresponds to the width of the nanocrystalline alloy ribbon piece. In the four sides of the multilayer block core 100, the frame widths W1 may be the same as or different from one another. The preferable range of the frame width W1 is substantially the same as the preferable range of the width of the nanocrystalline alloy ribbon piece described above.

The layer number (the number of the nanocrystalline alloy ribbon pieces that have been layered) in the multilayer block core 100 is preferably from 100 to 4000, and more preferably from 200 to 3000.

As described above, the space factor of the multilayer block core 100 is preferably from 85% to 92%, and preferably from 86% to 90%.

Note that, in this specification, the expression "shape of a rectangular ring" means a shape in general, which is obtained by providing a rectangular parallelopiped opening (namely, a hollow space) in a rectangular parallelopiped, the opening penetrating between two surfaces, that are parallel to each other, among the six surfaces of this rectangular parallelopiped.

For example, there may be a case in which the shape of the multilayer block core 100 is a shape of a rectangular tube (for example, the case in which the layer number in the multilayer blocks 10A to 10D is large, or the like), and such a shape of a rectangular tube is also included in the expression "shape of a rectangular ring" used in this specification.

The above specific example is an example in which four multilayer blocks are arranged in the shape of a rectangular ring. However, the embodiment of the invention is not limited to the above specific example.

For example, the multilayer block core according to the embodiment of the invention may be a multilayer block core in which five or more multilayer blocks are arranged in the shape of a rectangular ring.

Further, the multilayer block core according to the embodiment of the invention may be a complex provided with:

a first multilayer block core which is the multilayer block core 100 described above, and a second multilayer block core in which at least four of the multilayer blocks according to the embodiment of the invention (other than the multilayer blocks that constitute the first multilayer block core) are arranged so as to circulate along the inner peripheral surface side of the first multilayer block core (the multilayer block core 100).

In this complex, it is preferable that the layering direction of nanocrystalline alloy ribbon pieces in the first multilayer block core is the same direction as the layering direction of nanocrystalline alloy ribbon pieces in the second multilayer block core. Further, in this complex, it is preferable that the inner peripheral surface of the first multilayer block core is in contact with the outer peripheral surface of the second multilayer block core.

In the core, there is a tendency that the magnetic flux density on the inner peripheral side becomes higher than the magnetic flux density on the outer peripheral side. Therefore, in the above complex, from the viewpoint of making this complex hard to be magnetically saturated, it is preferable that the Bs of the nanocrystalline alloy ribbon pieces in the second multilayer block core located on the inner peripheral side is higher than the Bs of the nanocrystalline alloy ribbon pieces in the first multilayer block core located on the outer peripheral side.

The multilayer block core according to the embodiment of the invention may further include other multilayer block (a multilayer block which is not involved in the formation of a rectangular ring), in addition to the multilayer blocks arranged in the shape of a rectangular ring.

Further, the specific example described above is an example of a rectangular ring shaped "Single-Phase Two-Limb Core". However, the multilayer block core according to the embodiment of the invention may be a mode of a "Three-Phase Three-Limb Core" in which two rectangular ring-shaped "Single-Phase Two-Limb Cores" are placed side by side.

<Nanocrystalline Alloy Ribbon Piece>

Next, the nanocrystalline alloy ribbon piece in the embodiment of the invention is described in more detail.

Note that, the following explanation on the composition of the nanocrystalline alloy ribbon piece is applicable to the (long) nanocrystalline alloy ribbon, from which the nanocrystalline alloy ribbon piece is cut out, and also to the amorphous alloy ribbon, which is the raw material of the nanocrystalline alloy ribbon.

The nanocrystalline alloy ribbon piece has a composition represented by Composition Formula (A) described below.

The nanocrystalline alloy ribbon piece having a composition represented by Composition Formula (A) described below can be produced by subjecting an amorphous alloy ribbon having a composition represented by Composition Formula (A) described below to a heat treatment to obtain a nanocrystalline alloy ribbon, and then cutting the nanocrystalline alloy ribbon. A preferable mode of this heat treatment is a mode of the "process for obtaining a nanocrystalline alloy ribbon" in the production method P described below. According to the "process for obtaining a nanocrystalline alloy ribbon" in the production method P described below, a nanocrystalline alloy ribbon in which undulation, wrinkles, and warpage are inhibited can be obtained. As a result, a multilayer block can be obtained, in which lowering of space factor and deterioration in magnetic properties, which are caused by the above undulation, wrinkles, or warpage, are suppressed.

$$Fe_{100-a-b-c-d}B_aSi_bCu_cM_d. \qquad \text{Composition Formula (A)}$$

[In Composition Formula (A), each of a, b, c, and d is an atomic percent, and the expressions $13.0 \le a \le 17.0$, $3.5 \le b \le 5.0$, $0.6 \le c \le 1.1$, and $0 \le d \le 0.5$ are satisfied. M represents at least one element selected from the group consisting of Ti, Zr, Hf, V, Nb, Ta, Cr, Mo, and W.]

Hereinafter, Composition Formula (A) described above is explained in more detail.

In Composition Formula (A), theoretically, 100−a−b−c−d (that is, atom % of Fe) is 76.4 or more.

Fe is the main component of the nanocrystalline alloy ribbon piece, and it is needless to say that Fe is an element that contributes to magnetic properties.

100−a−b−c−d is preferably 78.0 or more, more preferably 80.0 or more, still more preferably more than 80.0, still more preferably 80.5 or more, and particularly preferably 81.0 or more.

The upper limit of 100−a−b−c−d is determined in accordance with a, b, c, and d.

In Composition Formula (A), a (that is, atom % of B) is from 13.0 to 17.0.

B has a function of stably maintaining the amorphous state in the amorphous alloy ribbon, which is the raw material of the nanocrystalline alloy ribbon piece, and thereby enhancing the uniformity of abundance of nanocrystal grains in the nanocrystalline alloy ribbon piece to be produced.

In the embodiment of the invention, when a in Composition Formula (A) is 13.0 or more, the above function of B is effectively exhibited. Further, when a in Composition Formula (A) is 13.0 or more, the ability to form an amorphous phase at the time of casting an amorphous alloy ribbon, which is the raw material of the nanocrystalline alloy ribbon piece, is improved and, as a result, coarsening of nanocrystal grains formed through heat treatment is suppressed.

On the other hand, when a in Composition Formula (A) is 17.0 or less, the content of Fe is ensured, and the Bs of the nanocrystalline alloy ribbon piece can be further improved.

In Composition Formula (A), b (that is, atom % of Si) is from 3.5 to 5.0.

Si has a function of raising the crystallization temperature of the amorphous alloy ribbon, which is the raw material of the nanocrystalline alloy ribbon piece, and also, forming a strong surface oxide film.

In the embodiment of the invention, when b in Composition Formula (A) is 3.5 or more, the above function of Si is effectively exhibited. Accordingly, it becomes possible to perform a heat treatment with higher temperature, and it becomes easy to efficiently form a dense and fine nanocrystalline structure. As a result, the Bs of the nanocrystalline alloy ribbon piece to be produced is further improved.

On the other hand, when b in Composition Formula (A) is 5.0 or less, the content of Fe is ensured, and the Bs of the nanocrystalline alloy ribbon piece is improved.

In Composition Formula (A), c (that is, atom % of Cu) is from 0.6 to 1.1.

Cu has a function of forming a Cu cluster and efficiently promoting nanocrystallization by using the Cu cluster as a nucleus, in the process for obtaining a nanocrystalline alloy ribbon through subjecting an amorphous alloy ribbon to a heat treatment.

In the embodiment of the invention, when c in Composition Formula (A) is 0.6 or more, the above function of Cu is effectively exhibited. Further, when c in Composition Formula (A) is 0.6 or more, Cu clusters each serving as a nucleus of a nanocrystal grain are easily formed in the state of being dispersed in the alloy structure and thus, coarsening of nanocrystal grains formed through heat treatment is suppressed and also, variation in grain size distribution of the nanocrystal grains is reduced.

On the other hand, when c in Composition Formula (A) is 1.1 or less, in the stage (liquid quenching stage) of preparing an amorphous alloy ribbon, formation of Cu clusters and precipitation of nanocrystal grains can be further suppressed. Accordingly, a nanocrystalline alloy ribbon can be prepared through heat treatment with favorable reproducibility.

Further, according to the production method P described below, even though Cu that contributes to the promotion of nanocrystallization is 1.1 atom % or less, nanocrystallization is easily promoted.

In Composition Formula (A), d (that is, atom % of M in Composition Formula (A), M representing at least one element selected from the group consisting of Ti, Zr, Hf, V, Nb, Ta, Cr, Mo, and W) is from 0 to 0.5.

M is an element that is optionally added, and the content of M may be 0 atom % (that is, d in Composition Formula (A) may be 0).

However, M has a function of stably maintaining the amorphous state in the amorphous alloy ribbon, which is the raw material of the nanocrystalline alloy ribbon piece, and thereby enhancing the uniformity of abundance of nanocrystal grains in the nanocrystalline alloy ribbon piece to be produced. From the viewpoint of exhibiting the above function of M, d in Composition Formula (A) preferably exceeds 0. From the viewpoint of exhibiting the above function of M more effectively, d in Composition Formula (A) is preferably 0.1 or more, and more preferably 0.2 or more.

On the other hand, d in Composition Formula (A) is preferably 0.5 or less.

When d in Composition Formula (A) is 0.5 or less, deterioration in soft magnetic properties is further suppressed.

From the viewpoints described above, d in Composition Formula (A) is preferably more than 0 but 0.5 or less, more preferably from 0.1 to 0.5, and particularly preferably from 0.2 to 0.5.

The nanocrystalline alloy ribbon piece may contain impurities other than Fe, B, Si, Cu, and M described above.

As the impurities, at least one element selected from the group consisting of Ni, Mn, and Co can be described. However, from the viewpoint of suppressing the deterioration in soft magnetic properties, the total content of these elements based on the total mass of the nanocrystalline alloy ribbon piece is preferably 0.4% by mass or less, more preferably 0.3% by mass or less, and particularly preferably 0.2% by mass or less.

Further, as the impurities, at least one element selected from the group consisting of Re, Zn, As, In, Sn, and rare earth elements can also be described. However, from the viewpoint of further enhancing the saturated magnetic flux density (Bs), the total content of these elements based on the total mass of the nanocrystalline alloy ribbon piece is preferably 1.5% by mass or less, and more preferably 1.0% by mass or less.

Examples of the impurities also include elements other than the elements described above, for example, O, S, P, Al, Ge, Ga, Be, Au, Ag, and the like.

The total content of the impurities in the nanocrystalline alloy ribbon piece is preferably 1.5% by mass or less, and more preferably 1.0% by mass or less, based on the total mass of the nanocrystalline alloy ribbon piece.

Preferable modes of the thickness and width of the nanocrystalline alloy ribbon piece, and the like are as described above.

[Method for Producing Multilayer Block (Production Method P)]

There is no particular restriction as to the method for producing the multilayer block according to the embodiment of the invention; however, the following production method P is preferable.

The production method P includes:

a process of preparing an amorphous alloy ribbon having a composition represented by Composition Formula (A) described above;

a process for obtaining a nanocrystalline alloy ribbon, the process including causing the amorphous alloy ribbon to travel continuously with tension F applied thereto, and bringing a partial region of the amorphous alloy ribbon, which is traveling continuously with tension F applied thereto, into contact with a heat transfer medium, whose temperature is maintained at 450° C. or higher, under conditions that satisfy the following Formula (1), whereby the temperature of the amorphous alloy ribbon is raised to an achievable temperature of 450° C. or higher at a temperature increase rate in which an average temperature increase rate in a temperature range of from 350° C. to 450° C. is 10° C./sec or higher, to obtain a nanocrystalline alloy ribbon;

a process of cutting out nanocrystalline alloy ribbon pieces from the nanocrystalline alloy ribbon; and a process of layering the nanocrystalline alloy ribbon pieces, to obtain a multilayer block.

$$t_c > 4/\sigma \quad \text{Formula (1)}$$

[In Formula (1), $t_c$ represents a time (sec) from a moment at which an arbitrary point of the amorphous alloy ribbon touches the heat transfer medium until a moment at which the arbitrary point separates from the heat transfer medium. $\sigma$ is defined by Formula (X) described below, and represents a contact pressure (kPa) between the amorphous alloy ribbon and the heat transfer medium.]

According to the process for obtaining a nanocrystalline alloy ribbon in the production method P, a nanocrystalline alloy ribbon in which undulation, wrinkles, and warpage are inhibited, can be obtained. As a result, a multilayer block can be obtained, in which lowering of space factor and deterioration in magnetic properties, which are caused by the above undulation, wrinkles, or warpage, are suppressed.

It is thought that the reason why a nanocrystalline alloy ribbon in which undulation, wrinkles, and warpage are inhibited can be obtained by the process for obtaining a nanocrystalline alloy ribbon is because variation in abundance of nanocrystal grains, which causes undulation, wrinkles, and warpage, can be reduced by this process.

The following reason can be thought of, as the reason why the variation in abundance of nanocrystal grains can be reduced by the process for obtaining a nanocrystalline alloy ribbon. However, the present invention is by no means limited to the following reason.

It is though that, generally, in the case of producing a nanocrystalline alloy ribbon through subjecting an amorphous ally ribbon to a heat treatment, a cluster (mainly, a Cu cluster in a case in which Cu is incorporated in the amorphous alloy ribbon), which is an aggregate of atoms, is formed by the movement of atoms during the process of raising the temperature for heat treatment, especially, during the process of raising the temperature within the region of from 350° C. to 450° C. Further, it is thought that, in the temperature region of 450° C. or higher, nanocrystal grains grow while using the cluster described above as a nucleus, whereby a nanocrystalline alloy ribbon is produced. Hereinafter, the growth of nanocrystal grains is also referred to as "nanocrystallization".

In this case, it is thought that, under the conditions where the size of a cluster becomes too large (namely, under the conditions where the moving time of atoms is relatively long), variation in abundance of clusters becomes great depending on the position thereof in the ribbon. It is thought that, as a result, also the variation in abundance of nanocrystal grains, that grow using the cluster as a nucleus, becomes great.

In view of the above circumstances, in the process for obtaining a nanocrystalline alloy ribbon, the temperature of the amorphous alloy ribbon is raised to an achievable temperature of 450° C. or higher at a temperature increase rate in which the average temperature increase rate (hereinafter, also referred to as the "average temperature increase rate $R_{350\text{-}450}$") in a temperature range of from 350° C. to 450° C. (namely, a temperature region in which clusters are formed) is 10° C./sec or higher (namely, the amorphous alloy ribbon is heat treated under the conditions). It is thought that, according to the above, the moving time of atoms for forming a cluster becomes short, and the phenomenon in which the size of a cluster that serves as a nucleus of a nanocrystal becomes too great is suppressed and, as a result, the variation in abundance of clusters is reduced.

Moreover, in this process, for the purpose of raising the temperature (that is, performing heat treatment) of the amorphous alloy ribbon, a partial region of the amorphous alloy ribbon, that travels continuously with tension F applied thereto, is brought into contact with a heat transfer medium, whose temperature is maintained at 450° C. or higher, under conditions that satisfy the following Formula (1). In detail, the time $t_c$ from the moment at which an arbitrary point of the amorphous alloy ribbon that travels continuously touches a heat transfer medium until the moment at which the arbitrary point separates from the heat transfer medium (namely, the time for the arbitrary point to pass through the heat transfer medium while contacting the heat transfer medium) is set to be more than $4/\sigma$. Thereby, heat transfer from the heat transfer medium to the amorphous alloy ribbon is sufficiently performed and nanocrystallization from amorphous is sufficiently promoted, to obtain a nanocrystalline alloy ribbon. In addition, as described above, it is thought that, by setting the average temperature increase rate $R_{350\text{-}450}$ to be 10° C./sec or higher, variation in abundance of clusters, each of which serves as a nucleus of a nanocrystal grain, is reduced.

In short, according to the process for obtaining a nanocrystalline alloy ribbon, by letting the average temperature increase rate $R_{350\text{-}450}$ be 10° C./sec or higher, the time for clusters to grow is shortened, and at the same time, by letting $t_c$ (seconds) be more than $4/\sigma$, the time for nanocrystallization is ensured and, as a result, a nanocrystalline alloy ribbon in which the uniformity of abundance of nanocrystal grains is improved can be obtained.

In this specification, the average temperature increase rate (the average temperature increase rate $R_{350\text{-}450}$) in the temperature region of from 350° C. to 450° C. means a value obtained by dividing the difference between 450° C. and 350° C. (that is, 100° C.) by the time (sec) from a moment at which the temperature of an arbitrary point of the amorphous alloy ribbon reaches 350° C. until a moment at which the temperature of the arbitrary point reaches 450° C.

In the process for obtaining a nanocrystalline alloy ribbon, the average temperature increase rate $R_{350\text{-}450}$ is 10° C./sec or higher.

When the average temperature increase rate $R_{350\text{-}450}$ is lower than 10° C./sec, the moving time of atoms for the growth of clusters is long, and the variation in abundance of clusters becomes great, as a result of which, uniformity in nanocrystallization is deteriorated, and undulation, wrinkles, and warpage are likely to occur in the nanocrystalline alloy ribbon to be obtained.

From the viewpoint of further inhibiting the occurrence of undulation, wrinkles, and warpage in the nanocrystalline alloy ribbon to be obtained, it is preferable that the average temperature increase rate $R_{350\text{-}450}$ is 100° C./sec or higher.

There is no particular restriction on the upper limit of the average temperature increase rate $R_{350\text{-}450}$. As the upper limit, for example, 10000° C./sec, 900° C./sec, 800° C./sec, or the like can be described.

Further, $\sigma$ in Formula (1) is defined by the following Formula (X), and represents a contact pressure between the amorphous alloy ribbon and the heat transfer medium.

$$\sigma=((F\times(\sin\theta+\sin\alpha))/a)\times1000 \quad \text{Formula (X)}$$

[In Formula (X), F represents a tension (N) applied to the amorphous alloy ribbon.

a represents a contact area ($mm^2$) between the amorphous alloy ribbon and the heat transfer medium.

$\theta$ is an angle formed by a travel direction of the amorphous alloy ribbon just before touching the heat transfer medium and the travel direction of the amorphous alloy ribbon at the time of being in contact with the heat transfer medium, and represents an angle of from 3° to 60°.

$\alpha$ is an angle formed by the travel direction of the amorphous alloy ribbon at the time of being in contact with the heat transfer medium and the travel direction of the nanocrystalline alloy ribbon just after separating from the heat transfer medium, and represents an angle of greater than 0° but no greater than 15°.]

Hereinafter, Formula (X) is explained in more detail.

In the process for obtaining a nanocrystalline alloy ribbon, a partial region of the amorphous alloy ribbon that travels continuously with tension F applied thereto is brought into contact with a heat transfer medium. Namely, the amorphous alloy ribbon travels continuously with tension F applied thereto, so as to pass through a heat transfer medium while keeping in contact with this heat transfer medium. By passing through the heat transfer medium, the amorphous alloy ribbon becomes a nanocrystalline alloy ribbon.

Since tension F is applied to the amorphous alloy ribbon, each of the travel direction of the amorphous alloy ribbon just before touching the heat transfer medium, the travel direction of the amorphous alloy ribbon at the time of being in contact with the heat transfer medium, and the travel direction of the nanocrystalline alloy ribbon just after separating from the heat transfer medium is linear.

However, on the upstream side of the "just before touching the heat transfer medium" in the travel direction, the amorphous alloy ribbon may travel in a zigzag line through conveyance rollers or the like. Similarly, on the downstream side of the "just after separating from the heat transfer medium" in the travel direction, the nanocrystalline alloy ribbon obtained from the amorphous alloy ribbon may travel in a zigzag line through conveyance rollers or the like.

In Formula (X), the angle $\theta$ (see FIG. 4; hereinafter also referred to as "approach angle $\theta$") formed by the travel direction of the amorphous alloy ribbon just before touching the heat transfer medium and the travel direction of the amorphous alloy ribbon at the time of being in contact with the heat transfer medium is from 3° to 60°.

From the viewpoint of more effectively ensuring $\sigma$, the approach angle $\theta$ is preferably from 5° to 60°, more preferably from 10° to 60°, and particularly preferably from 15° to 50°.

In Formula (X), the angle $\alpha$ (see FIG. 4; hereinafter also referred to as "exit angle $\alpha$") formed by the travel direction of the amorphous alloy ribbon at the time of being in contact with the heat transfer medium and the travel direction of the nanocrystalline alloy ribbon just after separating from the heat transfer medium is greater than 0° but no greater than 15°.

The exit angle $\alpha$ is preferably from 0.05° to 10°, and more preferably from 0.05 to 5°.

In this process, the contact of a partial region of the amorphous alloy ribbon, which travels continuously, and a heat transfer medium is performed in the state in which tension F is applied to the amorphous alloy ribbon.

In other words, tension F in Formula (X) exceeds 0 N.

In this process, tension F exceeds 0 N, sin $\theta$ exceeds 0 (in detail, $\theta$ is from 3° to 60°), and sin $\alpha$ exceeds 0 (in detail, $\alpha$ is greater than 0° but no greater than 15°). Accordingly, the contact pressure ($\sigma$) also exceeds 0 kPa. Since the contact pressure ($\sigma$) exceeds 0 kPa, heat transfer from the heat transfer medium to the amorphous alloy ribbon is carried out effectively.

Tension F is preferably from 1.0 N to 40.0 N, more preferably from 2.0 N to 35.0 N, and particularly preferably from 3.0 N to 30.0 N.

When tension F is 1.0 N or more, occurrence of undulation, wrinkles, and warpage can be further inhibited in the nanocrystalline alloy ribbon to be produced.

When tension F is 40.0 N or less, breakage of the amorphous alloy ribbon or nanocrystalline alloy ribbon can be further prevented.

In Formula (X), the contact area a between the amorphous alloy ribbon and the heat transfer medium is preferably 500 $mm^2$ or more, and more preferably 1000 $mm^2$ or more, from the viewpoint of effectively promoting the nanocrystallization. There is no particular restriction on the upper limit of the contact area a. From the viewpoint of productivity, the upper limit of the contact area a is, for example, 10000 $mm^2$, and preferably 8000 $mm^2$ or less.

Although it depends on the width of the amorphous alloy ribbon, the length of the contact portion between the amorphous alloy ribbon and the heat transfer medium in the ribbon travel direction is preferably 30 mm or more, and more preferably 50 mm or more, from the viewpoint of more effectively promoting the nanocrystallization.

There is no particular restriction on the upper limit of the length of the contact portion in the ribbon travel direction. From the viewpoint of productivity, the upper limit of the length of the contact portion in the ribbon travel direction is, for example, 1000 mm, and preferably 500 mm.

In Formula (X) and Formula (1), $\sigma$ is preferably 0.1 kPa or more, and preferably 0.4 kPa or more.

When $\sigma$ is 0.1 kPa or more, the above-described average temperature increase rate $R_{350\text{-}450}$ (10° C./sec or higher) is achieved more easily. Further, $\sigma$ being 0.1 kPa or more is advantageous in terms of reduction in coercive force (Hc).

There is no particular restriction on the upper limit of $\sigma$. The upper limit is, for example, 20 kPa.

Further, in Formula (1), there is no particular restriction on the upper limit of the time ($t_c$) from the moment at which an arbitrary point of the amorphous alloy ribbon touches a heat transfer medium until the moment at which the arbitrary point separates from the heat transfer medium. $t_c$ is preferably 300 sec or less, more preferably 100 sec or less, still more preferably 50 sec or less, and particularly preferably 10 sec or less.

When $t_c$ is 300 sec or less, productivity of the nanocrystalline alloy ribbon is further enhanced.

Further, when $t_c$ is 300 sec or less, the frequency of precipitation of an Fe—B compound, which may deteriorate the soft magnetic properties (a coercive force (Hc), a saturated magnetic flux density (Bs), and the like) of the nanocrystalline alloy ribbon, can be further reduced.

Note that, as far as Formula (1) is satisfied, there is no particular restriction on the lower limit of $t_c$. From the viewpoint of production stability, $t_c$ is preferably 0.5 sec or more.

As described above, in this process, Formula (1) ($t_c>4/\sigma$) is satisfied.

In this process, the ratio ($t_c/(4/\sigma)$) of $t_c$ to ($4/\sigma$) is preferably 1.1 or more, and more preferably 1.2 or more.

In this process, the difference ($t_c-(4/\sigma)$) between $t_c$ and ($4/\sigma$) is preferably 0.3 or more, and more preferably 0.5 or more.

Hereinafter, a preferable mode of the production method P is described in more detail.

<Process of Preparing Amorphous Alloy Ribbon>

This process includes preparing an amorphous alloy ribbon having a composition represented by Composition Formula (A) described above.

The amorphous alloy ribbon is a raw material of the nanocrystalline alloy ribbon.

The amorphous alloy ribbon can be produced by a known method such as a liquid quenching method including discharging a molten alloy onto an axially-rotated chill roll. However, the process of preparing an amorphous alloy ribbon is not necessarily be a process of producing an amorphous alloy ribbon, and may be a process of merely preparing an amorphous alloy ribbon that has been produced in advance.

Preferable ranges of the width and thickness of the amorphous alloy ribbon are substantially the same as the preferable ranges of the width and thickness of the nanocrystalline alloy ribbon piece.

The process of preparing an amorphous alloy ribbon may include preparing a roll of the amorphous alloy ribbon.

In this case, in the following process for obtaining a nanocrystalline alloy ribbon, the amorphous alloy ribbon unwound from the roll of the amorphous alloy ribbon is made to travel continuously with tension F applied thereto.

<Process for Obtaining Nanocrystalline Alloy Ribbon>

This process includes causing the amorphous alloy ribbon to travel continuously with tension F applied thereto, and bringing a partial region of the amorphous alloy ribbon, which is traveling continuously with tension F applied thereto, into contact with a heat transfer medium, whose temperature is maintained at 450° C. or higher, under conditions that satisfy Formula (1) described above, whereby the temperature of the amorphous alloy ribbon is raised to an achievable temperature of 450° C. or higher at a temperature increase rate in which an average temperature increase rate in a temperature range of from 350° C. to 450° C. is ° C./sec or higher, to obtain a nanocrystalline alloy ribbon.

A part of the preferable mode of the process for obtaining a nanocrystalline alloy ribbon is as described above.

Examples of the heat transfer medium include a plate, a twin roll, and the like.

Examples of the material of the heat transfer medium include copper, a copper alloy (bronze, brass, or the like), aluminum, iron, and an iron alloy (stainless steel, or the like). Among them, copper, a copper alloy, or aluminum is preferable.

The heat transfer medium may be subjected to a plating treatment such as Ni plating or Ag plating.

The temperature of the heat transfer medium is 450° C. or higher, as described above. Thereby, nanocrystallization is promoted in the structure of the ribbon.

The temperature of the heat transfer medium is preferably from 450° C. to 550° C.

When the temperature of the heat transfer medium is 550° C. or lower, the frequency of precipitation of an Fe—B compound, which may deteriorate the soft magnetic properties (Hc, Bs, and the like) of the nanocrystalline alloy ribbon, can be further reduced.

Further, in this process, the temperature of the amorphous alloy ribbon is raised to an achievable temperature of 450° C. or higher. Accordingly, nanocrystallization is promoted in the structure of the ribbon.

The achievable temperature is preferably from 450° C. to 550° C.

When the achievable temperature is 550° C. or lower, the frequency of precipitation of an Fe—B compound, which may deteriorate the soft magnetic properties (Hc, Bs, and the like) of the nanocrystalline alloy ribbon, can be further reduced.

Further, the achievable temperature is preferably the same temperature as the temperature of the heat transfer medium.

In this process, after raising the temperature, the temperature of the nanocrystalline alloy ribbon may be maintained for a definite time, on the heat transfer medium.

Further, in this process, it is preferable that the obtained nanocrystalline alloy ribbon is cooled (preferably, to room temperature).

Moreover, this process may include winding up the obtained nanocrystalline alloy ribbon (preferably, the nanocrystalline alloy ribbon that has been cooled), to obtain a roll of the nanocrystalline alloy ribbon.

<One Preferable Mode (Mode X) of Process for Obtaining Nanocrystalline Alloy Ribbon>

A preferable example of a mode of the process for obtaining a nanocrystalline alloy ribbon is a mode (hereinafter, referred to as "mode X") of preparing a nanocrystalline alloy ribbon by subjecting the amorphous alloy ribbon to a heat treatment through bringing the amorphous alloy ribbon into contact with the heat transfer medium, using an in-line annealing apparatus equipped with a heat transfer medium.

Figure 4:
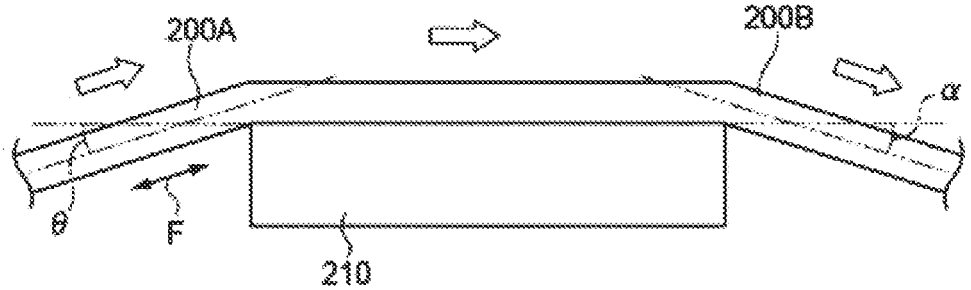
FIG. 4 is a fragmentary side view schematically showing a heat transfer medium of an inline annealing apparatus and an amorphous alloy ribbon that contacts the heat transfer medium (after contacting the heat transfer medium, a nanocrystalline alloy ribbon) in one mode of the embodiment of the invention.

FIG. 4 is a fragmentary side view schematically showing a heat transfer medium of an inline annealing apparatus and an amorphous alloy ribbon that contacts the heat transfer medium (after contacting the heat transfer medium, a nanocrystalline alloy ribbon) in the mode X.

As shown in FIG. 4, in the mode X, by bringing an amorphous alloy ribbon 200A, that travels continuously toward the direction shown by the block arrows, into contact with a heat transfer medium 210, whose temperature is maintained at 450° C. or higher, the amorphous alloy ribbon 200A is continuously heat treated. Hereinafter, details concerning this heat treatment is described step by step for convenience of explanation; however, the following heat treatment is performed continuously.

First, the amorphous alloy ribbon 200A with tension F applied thereto by using a tensioner (not shown) is made to enter the heat transfer medium 210, whose temperature is maintained at 450° C. or higher, at an approach angle θ. Accordingly, the amorphous alloy ribbon 200A is brought into contact with the heat transfer medium 210.

Subsequently, the amorphous alloy ribbon 200A is heat treated by using the heat transfer medium 210, to obtain a nanocrystalline alloy ribbon 200B. In detail, by contacting the heat transfer medium 210 under conditions that satisfy Formula (1) ($t_c>4/\sigma$) described above, the temperature of the amorphous alloy ribbon 200A is raised to a temperature of 450° C. or higher at a temperature increase rate in which the average temperature increase rate $R_{350-450}$ in a temperature range of from 350° C. to 450° C. is 10° C./sec or higher, to obtain a nanocrystalline alloy ribbon 200B.

Preferable ranges of the average temperature increase rate $R_{350-450}$ and, $t_c$ and $\sigma$ in Formula (1) are as described above.

After the heat treatment, the nanocrystalline alloy ribbon 200B is made to leave from the heat transfer medium 210 at an exit angle α, followed by cooling (air cooling) to room temperature. Thereafter, the nanocrystalline alloy ribbon 200B is wound up by a wind-up roll (not shown).

<Process of Cutting Out Nanocrystalline Alloy Ribbon Pieces>

This process includes cutting out nanocrystalline alloy ribbon pieces from the nanocrystalline alloy ribbon described above.

Here, "cutting out nanocrystalline alloy ribbon pieces from the nanocrystalline alloy ribbon" can be carried out by cutting the nanocrystalline alloy ribbon so as to obtain a desired length in the longitudinal direction (for example, the length of the long side of the aimed multilayer block).

In this process, in a case in which the length of the short side of the aimed multilayer block is the same as the width of the nanocrystalline alloy ribbon, it is enough to perform only cutting to obtain the above-described desired length in the longitudinal direction.

Further, in a case in which the length of the short side of the aimed multilayer block is shorter than the width of the nanocrystalline alloy ribbon, it is enough to perform cutting to obtain the above-described desired length in the longitudinal direction, followed by processing (at least one of cutting or polishing) to obtain the desired length in the width direction (for example, the length of the short side of the multilayer block to be produced).

Cutting out nanocrystalline alloy ribbon pieces (namely, cutting of the nanocrystalline alloy ribbon) can be carried out by using a known cutting means such as a grinding stone or a diamond cutter.

In a case in which the nanocrystalline alloy ribbon is wound up into a roll in the above-described process for obtaining a nanocrystalline alloy ribbon, the nanocrystalline alloy ribbon is unwound from the roll of the nanocrystalline alloy ribbon and then nanocrystalline alloy ribbon pieces are cut out from the unwound nanocrystalline alloy ribbon in the process of cutting out nanocrystalline alloy ribbon pieces.

<Process for Obtaining Multilayer Block>

This process includes layering the nanocrystalline alloy ribbon pieces, to obtain a multilayer block.

It is preferable that this process includes layering the nanocrystalline alloy ribbon pieces, impregnating a resin (for example, an acrylic resin, an epoxy resin, or the like) into at least a portion between the nanocrystalline alloy ribbon pieces thus layered, and then curing the resin.

By curing the impregnated resin, the plural nanocrystalline alloy ribbon pieces are fixed and thus, the shape (for example, a rectangular parallelopiped shape) of the multilayer block is easily maintained.

This process may include polishing the end faces of the layered nanocrystalline alloy ribbon pieces in the multilayer block, performing etching removal using an acid or the like to remove residual processing stress in the cut surface, and the like.

The production method P may include an additional process other than the process described above.

An example of the additional process is a process for obtaining a multilayer block core by using plural (preferably, four or more) multilayer blocks in combination.

Preferable mode of the arrangement of plural multilayer blocks in a multilayer block core is as described above.

The plural multilayer blocks may be bonded using an adhesive or the like. Alternatively, the plural multilayer blocks may be fixed by accommodating them in a plastic case having a predetermined shape, such that the connecting parts of the multilayer blocks certainly contact each other.

EXAMPLES

Hereinafter, examples of the present invention will be described; however, the present invention is by no means limited to the following examples.

Example 1

<Preparation of Multilayer Block>

An amorphous alloy ribbon having a composition of $Fe_{81.3}B_{13.8}Si_{4.0}Cu_{0.7}Mo_{0.2}$ (each of the suffixes is an atomic percent) and having a width of 19 mm and a thickness of 23 μm was produced by a liquid quenching method including discharging a molten alloy onto an axially-rotated chill roll.

From the results of X-ray diffraction and observation using a transmission type electron microscope (TEM), precipitation of nanocrystals was not confirmed in the amorphous phase of the amorphous alloy ribbon.

Next, according to the mode X described above, using an in-line annealing apparatus equipped with a heat transfer medium, the amorphous alloy ribbon was brought into contact with the heat transfer medium and heat treated, whereby a nanocrystalline alloy ribbon was prepared. The nanocrystalline alloy ribbon thus obtained was left from the heat transfer medium, then was cooled (air-cooled) to room temperature, and then was wound up into a roll of the nanocrystalline alloy ribbon.

The production conditions in Example 1 are as follows.

—Production Conditions in Example 1—

Heat transfer medium: a plate made of bronze

Temperature of the heat transfer medium: 510° C.

Tension F applied to the amorphous alloy ribbon: 30 N

Contact area a between the amorphous alloy ribbon and the heat transfer medium: 1880 $mm^2$ Approach angle θ: 45°

Contact pressure σ between the amorphous alloy ribbon and the heat transfer medium: 12.7 kPa (a value calculated based on Formula (X) above)

$4/\sigma$ : 0.3 (a value calculated based on σ above)

Contact time tc between the amorphous alloy ribbon and the heat transfer medium: 0.9 sec Exit angle α: 5°

Average temperature rising rate $R_{350-450}$: higher than 200° C./sec

Achievable temperature $T_a$: 510° C.

A cross section of the nanocrystalline alloy ribbon that had been cooled was observed using a TEM, and it was confirmed that nanocrystals were incorporated in the nanocrystalline alloy ribbon that had been cooled. In detail, the content of nanocrystal grains having a grain size of from 1 nm to 30 nm in the nanocrystalline alloy ribbon that had been cooled was 45% by volume. The remainder was an amorphous phase.

Note that, in the examples, the percentage (%) of the area of nanocrystal grains having a grain size of from 1 nm to 30 nm relative to the entire area of the TEM image in a visual field area of 1 μm×1 μm was determined, and this percentage (%) of area is designated as the content (% by volume) of the nanocrystal grain phase in the nanocrystalline alloy ribbon.

Further, from the ICP (inductively coupled plasma) emission spectral analysis, it was confirmed that the composition of the nanocrystalline alloy ribbon that had been cooled was the same as the composition of the amorphous alloy ribbon as the raw material.

Next, the nanocrystalline alloy ribbon was unwound from the roll of the nanocrystalline alloy ribbon, and the nanocrystalline alloy ribbon that had been unwound was cut, whereby 1320 sheets of nanocrystalline alloy ribbon pieces having a length of 86 mm in the longitudinal direction were cut out. Cutting of the nanocrystalline alloy ribbon was carried out using a cutter blade equipped with a rotary grindstone.

The 1320 sheets of nanocrystalline alloy ribbon pieces were layered to obtain a multilayer body. Subsequently, an acrylic resin was impregnated between the nanocrystalline alloy ribbon pieces in the multilayer body in accordance with vacuum impregnation, and then the acrylic resin was cured.

The end face of the multilayer body (the face including the end faces of the nanocrystalline alloy ribbon pieces) was polished, and then etching removal of about several μm was performed, thereby obtaining a multilayer block.

By the operations described above, two multilayer blocks each having a length of 85 mm, a width of 18 mm, and a thickness (layering thickness) of 35 mm were prepared.

Further, two multilayer blocks each having a length of 63 mm, a width of 18 mm, and a thickness (layering thickness) of 35 mm were prepared in a manner substantially similar to the manner described above, except that the length in the longitudinal direction in the nanocrystalline alloy ribbon pieces to be cut out was changed to 64 mm.

The space factor in each of the multilayer blocks (namely, the space factor in the multilayer block core described below) was determined, based on the layer number (in each of the multilayer blocks, 1320 layers) of the nanocrystalline alloy ribbon pieces in each of the multilayer blocks, and it was revealed that the space factor was 87%. The formula for calculation of space factor is shown below.

$$\text{Space Factor (\%)}=((23\times1320)/35000)\times100$$

<Preparation of Multilayer Block Core>

The four multilayer blocks described above were arranged similarly to the case of the multilayer blocks 10A to 10D (FIG. 1) described above, whereby a multilayer block core having a configuration similar to that of the multilayer block core 100 described above and having a shape of a rectangular ring was obtained.

Concerning the size of the multilayer block core thus prepared, the length L in the longitudinal direction was 121 mm, the length W in the width direction was 63 mm, the thickness T was 35 mm, and the frame width W1 was 18 mm.

<Measurement of Magnetic Properties of Multilayer Block Core>

With regard to the multilayer block core of Example 1, as magnetic properties, Bs (T) and Hc (A/m) of the nanocrystalline alloy ribbon piece were measured. As described above, the Bs was determined in accordance with a VSM measurement with respect to the nanocrystalline alloy ribbon piece incorporated in the multilayer block core (also the Bs in Example 2 described below was determined in a similar manner).

As a result, in the multilayer block core of Example 1, the Bs and Hc of the nanocrystalline alloy ribbon piece were 1.71 T and 4.0 A/m, respectively.

As described above, the multilayer block core of Example 1 had excellent magnetic properties, as compared with the multilayer block core for comparison described below.

Example 2

Operations substantially similar to those in Example 1 were carried out, except that the composition of the amorphous alloy ribbon as the raw material was changed to $Fe_{81.8}B_{13.3}Si_{3.8}Cu_{0.8}Mo_{0.3}$ (each of the suffixes is an atomic percent) and the temperature of the heat transfer medium was changed to 498° C.

With regard to the multilayer block core of Example 1, as magnetic properties, Bs (T) and Hc (A/m) of the nanocrystalline alloy ribbon piece were measured.

As a result, the Bs and Hc were 1.72 T and 4.0 A/m, respectively.

As described above, the multilayer block core of Example 2 had excellent magnetic properties, as compared with the multilayer block core for comparison described below.

Comparative Example 1

A multilayer block core for comparison having a structure in which amorphous alloy ribbon pieces are layered was prepared in a manner substantially similar to that in Example 1, except that the nanocrystalline alloy ribbon was changed to an amorphous alloy ribbon having a composition of $Fe_{80}Si_9B_{11}$ (each of the suffixes is an atomic percent).

In the multilayer block core for comparison, the Bs of the amorphous alloy ribbon piece was 1.56 T.

The disclosure of U.S. Provisional Patent Application No. 62/300,937, filed on Feb. 29, 2016 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

What is claimed is:

1. A multilayer block core, comprising a multilayer block in which nanocrystalline alloy ribbon pieces of a nanocrystalline alloy ribbon are layered, the nanocrystalline alloy ribbon pieces having a composition represented by the following Composition Formula (A):

$$Fe_{100-a-b-c-d}B_aSi_bCu_cM_d \qquad \text{[Composition Formula (A)]}$$

wherein, in Composition Formula (A), each of a, b, c, and d is an atomic percent; the expressions $13.3\leq a\leq17.0$, $3.5\leq b\leq5.0$, $0.6\leq c\leq1.1$, and $0\leq d\leq0.5$ are satisfied; and M represents at least one element selected from the group consisting of Ti, Zr, Hf, V, Nb, Ta, Cr, Mo, and W, wherein the nanocrystalline alloy ribbon pieces have been heat treated, whereby the temperature of the amorphous alloy ribbon is raised to an achievable temperature of 450° C. or higher, at a temperature increase rate in which an average temperature increase rate in a temperature range of from 350° C. to 450° C. is 10° C./sec or higher, to obtain a nanocrystalline alloy ribbon, and whereby the nanocrystalline alloy ribbon pieces have a high saturated magnetic flow density Bs of 1.70 T or higher, wherein the multilayer block is a rectangular parallelopiped block having a structure in which long, flat plate-shaped nanocrystalline alloy ribbon pieces are layered, wherein, due to cured resin, the plural nanocrystalline alloy ribbon pieces are fixed to one another and the rectangular parallelopiped shape of the multilayer block is maintained, wherein the nanocrystalline alloy ribbon consists of only nanocrystals or of nanocrystals dispersed in an amorphous phase, wherein each of the nanocrystalline alloy ribbon pieces contains nanocrystal grains having a grain size of from 1 nm to 30 nm in an amount of from 30% by volume to 60% by volume, wherein each of the nanocrystalline alloy ribbon pieces has a thickness of from 10 μm to 30 μm, a width of from 5 mm to 100 mm, and a ratio of length to width of from 1 to 10, and wherein a space factor of the multilayer block is from 85% to 92%.

2. The multilayer block core according to claim 1, wherein:

each of the nanocrystalline alloy ribbon pieces has a rectangular shape, the multilayer block has a rectangular parallelopiped shape, the multilayer block core is provided with at least four of the multilayer blocks, the at least four multilayer blocks are arranged in the shape of a rectangular ring, and a layering direction of the nanocrystalline alloy ribbon pieces in the multilayer blocks arranged in the shape of a rectangular ring is the same direction as a normal line direction of an arrangement face of the multilayer blocks arranged in the shape of a rectangular ring.

3. The multilayer block core according to claim 2, wherein:

each of the nanocrystalline alloy ribbon pieces contains nanocrystal grains having a grain size of from 1 nm to 30 nm in an amount of from 30% by volume to 60% by volume, and has a thickness of from 10 μm to 30 μm, a width of from 5 mm to 100 mm, and a ratio of length to width of from 1 to 10; and a space factor of the multilayer block core is from 85% to 92%.

4. A multilayer block in which nanocrystalline alloy ribbon pieces of a nanocrystalline alloy ribbon are layered, the nanocrystalline alloy ribbon pieces having a composition represented by the following Composition Formula (A):

$$Fe_{100-a-b-c-d}B_aSi_bCu_cM_d \quad \text{[Composition Formula (A)]}$$

wherein, in Composition Formula (A), each of a, b, c, and d is an atomic percent; the expressions $13.3 \le a \le 17.0$, $3.5 \le b \le 5.0$, $0.6 \le c \le 1.1$, and $0 \le d \le 0.5$ are satisfied; and M represents at least one element selected from the group consisting of Ti, Zr, Hf, V, Nb, Ta, Cr, Mo, and W, wherein the nanocrystalline alloy ribbon pieces have been heat treated, whereby the temperature of the amorphous alloy ribbon is raised to an achievable temperature of 450° C. or higher, at a temperature increase rate in which an average temperature increase rate in a temperature range of from 350° C. to 450° C. is 10° C./sec or higher, to obtain a nanocrystalline alloy ribbon, and whereby the nanocrystalline alloy ribbon pieces have a high saturated magnetic flow density Bs of 1.70 T or higher, wherein the multilayer block is a rectangular parallelopiped block having a structure in which long, flat plate-shaped nanocrystalline alloy ribbon pieces are layered, wherein, due to cured resin, the plural nanocrystalline alloy ribbon pieces are fixed to one another and the rectangular parallelopiped shape of the multilayer block is maintained, wherein the nanocrystalline alloy ribbon consists of only nanocrystals or of nanocrystals dispersed in an amorphous phase, wherein each of the nanocrystalline alloy ribbon pieces contains nanocrystal grains having a grain size of from 1 nm to 30 nm in an amount of from 30% by volume to 60% by volume, wherein each of the nanocrystalline alloy ribbon pieces has a thickness of from 10 μm to 30 μm, a width of from 5 mm to 100 mm, and a ratio of length to width of from 1 to 10, and wherein a space factor of the multilayer block is from 85% to 92%.

5. A method for producing the multilayer block according to claim 4, the method comprising:

preparing an amorphous alloy ribbon having a composition represented by Composition Formula (A);

causing the amorphous alloy ribbon to travel continuously with tension F applied thereto, and bringing a partial region of the amorphous alloy ribbon, which is traveling continuously with tension F applied thereto, into contact with a heat transfer medium, whose temperature is maintained at 450° C. or higher, under conditions that satisfy the following Formula (1), whereby the temperature of the amorphous alloy ribbon is raised to an achievable temperature of 450° C. or higher at a temperature increase rate in which an average temperature increase rate in a temperature range of from 350° C. to 450° C. is 10° C./sec or higher, to obtain a nanocrystalline alloy ribbon;

cutting out nanocrystalline alloy ribbon pieces from the nanocrystalline alloy ribbon; and layering the nanocrystalline alloy ribbon pieces, to obtain the multilayer block:

$$t_c > 4/\sigma \quad \text{[Formula (1)]}$$

wherein, in Formula (1), $t_c$ represents a time (sec) from a moment at which an arbitrary point of the amorphous alloy ribbon touches the heat transfer medium until a moment at which the arbitrary point separates from the heat transfer medium; and $\sigma$ is defined by the following Formula (X), and represents a contact pressure (kPa) between the amorphous alloy ribbon and the heat transfer medium:

$$\sigma = ((F \times (\sin\theta + \sin\alpha))/a) \times 1000 \quad \text{Formula (X)}$$

wherein, in Formula (X), F represents a tension (N) applied to the amorphous alloy ribbon; a represents a contact area ($mm^2$) between the amorphous alloy ribbon and the heat transfer medium; $\theta$ is an angle formed by a travel direction of the amorphous alloy ribbon just before touching the heat transfer medium and a travel direction of the amorphous alloy ribbon at a time of being in contact with the heat transfer medium, and represents an angle of from 3° to 60°; and $\alpha$ is an angle formed by the travel direction of the amorphous alloy ribbon at the time of being in contact with the heat transfer medium and a travel direction of the nanocrystalline alloy ribbon just after separating from the heat transfer medium, and represents an angle of greater than 0° but no greater than 15°.

* * * * *